US010765605B2

(12) United States Patent
Hsiao

(10) Patent No.: US 10,765,605 B2
(45) Date of Patent: Sep. 8, 2020

(54) INTELLIGENT PILLBOX WITH VOLUME DETECTION

(71) Applicants: Inventec Appliances (Pudong) Corporation, Shanghai (CN); INVENTEC APPLIANCES (SHANGHAI) CO., LTD., Shanghai (CN)

(72) Inventor: Chih-Hsuan Hsiao, Shanghai (CN)

(73) Assignees: INVENTEC APPLIANCES (PUDONG) CORPORATION, Shanghai (CN); INVENTEC APPLIANCES (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/389,687

(22) Filed: Apr. 19, 2019

(65) Prior Publication Data

US 2020/0138670 A1 May 7, 2020

(30) Foreign Application Priority Data

Nov. 1, 2018 (CN) ..... 2018 1 1295545

(51) Int. Cl.

| | |
|---|---|
| ***G08B 1/08*** | (2006.01) |
| ***A61J 7/04*** | (2006.01) |
| ***A61J 1/03*** | (2006.01) |
| ***G08B 21/24*** | (2006.01) |

(52) U.S. Cl.

CPC ..... *A61J 7/0436* (2015.05); *A61J 1/03* (2013.01); *A61J 7/0418* (2015.05); *A61J 7/0454* (2015.05); *G08B 21/24* (2013.01); *A61J 2200/30* (2013.01); *A61J 2200/70* (2013.01)

(58) Field of Classification Search

CPC ..... A61J 7/0436; A61J 7/0418; A61J 7/0454; A61J 1/03; G08B 21/24

See application file for complete search history.

(56) References Cited

U.S. PATENT DOCUMENTS

| | | | | |
|---|---|---|---|---|
| 2014/0244033 | A1* | 8/2014 | Ucer | A61J 7/0481 700/237 |
| 2014/0262918 | A1* | 9/2014 | Chu | A61J 1/03 206/534 |
| 2017/0087059 | A1* | 3/2017 | Rodriguez | G16H 20/13 |

(Continued)

FOREIGN PATENT DOCUMENTS

| | | | |
|---|---|---|---|
| CN | 107334636 | A | 11/2017 |
| WO | WO2017199255 | A1 | 11/2017 |

*Primary Examiner* — Phung Nguyen

(57) ABSTRACT

An intelligent pillbox with volume detection includes an open-close structure, a first structure, an air pressure sensing module and a processor. The first structure is movably configured on the open-close structure, and moves in and out of the containing space of the open-close structure to generate a constant volume difference. The air pressure sensing module is configured in the containing space for measuring the multiple air pressure values in the airtight space. The intelligent pillbox with volume detection calculates the medicine volume by the constant volume differences and the air pressure change when the patient takes out the medicine from the medicine box. It not only can avoid the patient taking wrong medicine, but also can detect the number of remaining medicine and remind the patient to replenish the medicine in the medicine box.

15 Claims, 7 Drawing Sheets

(56) References Cited

U.S. PATENT DOCUMENTS

| | | | | |
|---|---|---|---|---|
| 2017/0169185 | A1* | 6/2017 | Weng | G06F 19/3418 |
| 2018/0250196 | A1* | 9/2018 | Warden | A61J 1/18 |
| 2019/0298607 | A1* | 10/2019 | Kaplan | A61J 1/1412 |

* cited by examiner

INTELLIGENT PILLBOX WITH VOLUME DETECTION

CROSS-REFERENCE TO RELATED APPLICATIONS

This application claims the priority benefit of Chinese Application Serial No. 201811295545.4 filed Nov. 1, 2018 the disclosure of which is incorporated herein by reference.

BACKGROUND OF THE INVENTION

1. Field of the Invention

The present invention relates to an intelligent pillbox, and especially, to an intelligent pillbox with volume detection.

2. Description of the Prior Art

Because of the rapid development of medicine, the mortality rate has decreased and the ratio of the elderly population to the total population has gradually increased. According to the definition by the World Health Organization (WHO), an aging society comprises 7% old people over 65 years old in the total population of the society; an aged society comprises 14% old people over 65 years old in total population of the society; and a super-aged society comprises 20% old people over 65 years old in total population of the society. According to statistics, many countries on the world have entered the aged societies.

As humans grow older, their physiology gradually declines and they might suffer from chronic diseases. According to the statistics, 80% of the elderly suffer from at least one chronic disease, and 50% of them have more than two. Chronic diseases could not be cured in a short period of time usually, and some chronic diseases even cannot be cured. Without treatment, the conditions of the patients having chronic diseases would deteriorate over time. Therefore, the elderly need long-term treatment to alleviate the symptoms caused by chronic diseases and control the progress of chronic diseases.

In General, the doctor usually treats or controls chronic diseases of patients by prescribing medicines, and the patient must take medication according to the time and dose recommended by the doctor to ensure the therapeutic effect of chronic medicines. However, the types of medicines must be taken are also determined according to the number of chronic diseases. Therefore, the more chronic diseases the patient suffering from, the more types of medicines are needed. Once the doctor's prescription is too complicated, it may lead to the risk of patients taking less, taking more or taking wrong medicines. It may not only affect the treatment effect, but also cause serious illness.

SUMMARY OF THE INVENTION

The present invention provides an intelligent pillbox with volume detection which calculating the medicine volume by the difference values of the air pressure and the volume. It not only can prevent the patient from taking wrong medicine, but also can detect the number of remaining medicine and remind the patient to replenish the medicine in the medicine box.

The present invention provides an intelligent pillbox with volume detection which including an open-close structure, a first structure, an air pressure sensing module and a processor. The open-close structure includes a containing space for containing a medicine, and the containing space is an airtight space when the open-close structure is closed. The first structure is movably configured on the open-close structure, and the first structure moves in and out of the airtight space to form a constant volume difference of the airtight space. The air pressure sensing module is configured in the containing space for measuring a plurality of air pressure values in the airtight space. The air pressure values includes a first air pressure value and a second air pressure value, wherein the first air pressure value is detected when the first structure moves into the airtight space and the second air pressure value is detected when the first structure moves out of the airtight space. An air pressure difference value is formed between the first air pressure value and the second air pressure value. The processor is connected to the open-close structure, and includes a volume calculating module coupled to the air pressure sensing module. The volume calculating module calculates an air volume value of the airtight space according to the air pressure difference value and the constant volume difference, and calculates a medicine volume according to a maximum volume value of the containing space and the air volume value.

In one embodiment, the first structure is a button set on and through the open-close structure. A pressure applying end of the button is disposed in the containing space, and a pressure receiving end of the button is configured outside of the open-close structure. The increased volume of the pressure applying end in the containing space is equal to the constant volume difference when an external force applies on the pressure receiving end to make the button move into the airtight space.

In one embodiment, the intelligent pillbox with volume detection further includes a storage module coupled to the volume calculating module of the processor. The storage module further includes a personal medicine volume characteristic database. The personal medicine volume characteristic database stores a plurality of volume data of medicine. The processor further includes a medicine type judging module coupled to the personal medicine volume characteristic database and the volume calculating module. The volume calculating module calculates the plurality of medicine volumes in multiple times and further calculates a volume change value respectively. The medicine type judging module compares whether the volume data matches the volume change value, and calculates a number of medicine taken out according to the volume change value and the volume data.

In one embodiment, the intelligent pillbox with volume detection further includes a time module for recording an instant time data. The storage module further includes a medical order database. The medical order database includes a medical order data. The medical order data includes a volume data and a corresponding time data for taking the medicine. The processor further includes a medical order judging module coupled to the time module and the medical order database. The medical order judging module compares whether the volume change value before and after a period of the taking time data is equal to the volume data for taking the medicine according to the instant time data; if not, the medical order judging module outputs a warning signal.

In one embodiment, the medical order judging module is further coupled to the medicine type judging module. The medical order judging module compares whether the number of medicine taken out of the containing space matches a medicine data for taking the medicine, and compares whether the instant time data matches to the time data for taking the medicine. If either one does not match, the medical order judging module outputs a warning signal.

In one embodiment, the storage module further includes a record database for taking the medicine coupled to the time module and the medicine type judging module. The record database for taking the medicine stores a record data for taking the medicine. The record data for taking the medicine includes the instant time data, the number of medicine taken out corresponding to the instant time data, the volume change value corresponding to the instant time data, and the air volume value corresponding to the instant time data.

In one embodiment, the processor further includes a medicine inventory calculating module coupled to the record database for taking the medicine. The medicine inventory calculating module stores a remaining time threshold value. The processor calculates a remaining time of the air volume value reaching the maximum volume value according to the record data for taking the medicine. The medicine inventory calculating module outputs a warning signal if the remaining time is less than the remaining time threshold value. In another one embodiment, the medicine inventory calculating module is coupled to the volume calculating module and the personal medicine volume characteristic database. The medicine inventory calculating module calculates a number of remaining medicine types according to the maximum volume value and the air volume value. The medicine inventory calculating module stores a quantity threshold value. The medicine inventory calculating module outputs a warning signal when the number of remaining medicine types is less than the quantity threshold value.

In one embodiment, the intelligent pillbox with volume detection further includes a sound-light output module coupled to the processor. The sound-light output module outputs a reminder message when receiving the warning signal from the processor.

In one embodiment, the intelligent pillbox with volume detection further includes a wireless communicating module coupled to the processor. The wireless communicating module is connected to a mobile device storing an application program for outputting the warning signal to the application program of the mobile device.

The intelligent pillbox with volume detection of the present invention calculates the medicine volume by generating the constant volume difference and detecting the air pressure change of the airtight space. It not only can prevent the patient from taking wrong medicine, but also can detect the number of remaining medicine and remind the patient to replenish the medicine in the medicine box.

BRIEF DESCRIPTION OF THE APPENDED DRAWINGS

Figure 1:
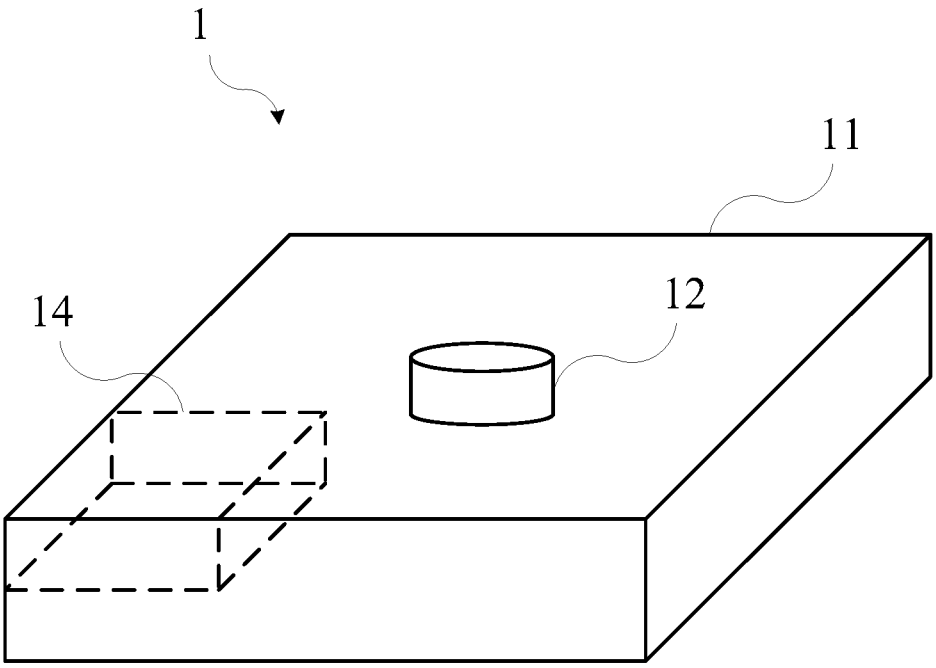
FIG. 1 is a simple schematic drawing illustrating an appearance of an intelligent pillbox with volume detection of the present invention.
Figure 3A:
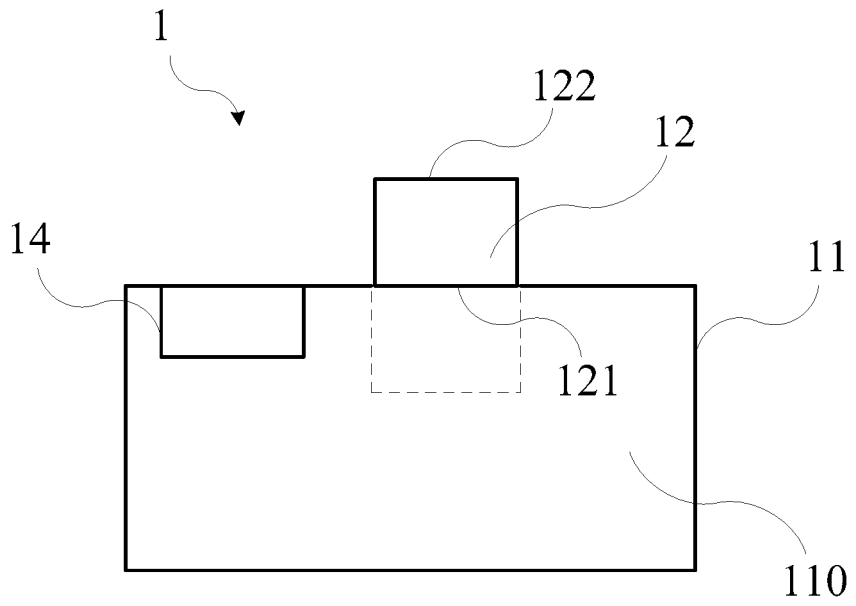

FIG. 3*a* is a sectional simple schematic drawing illustrating the button moving out according to the embodiment of FIG. 1.

Figure 3B:
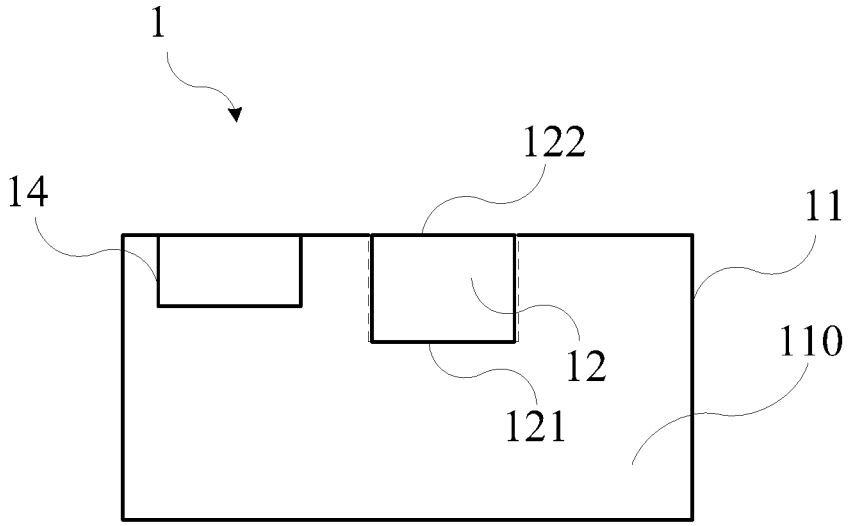

FIG. 3*b* is a sectional simple schematic drawing illustrating the button moving in according to the embodiment of FIG. 1.

Figure 4:
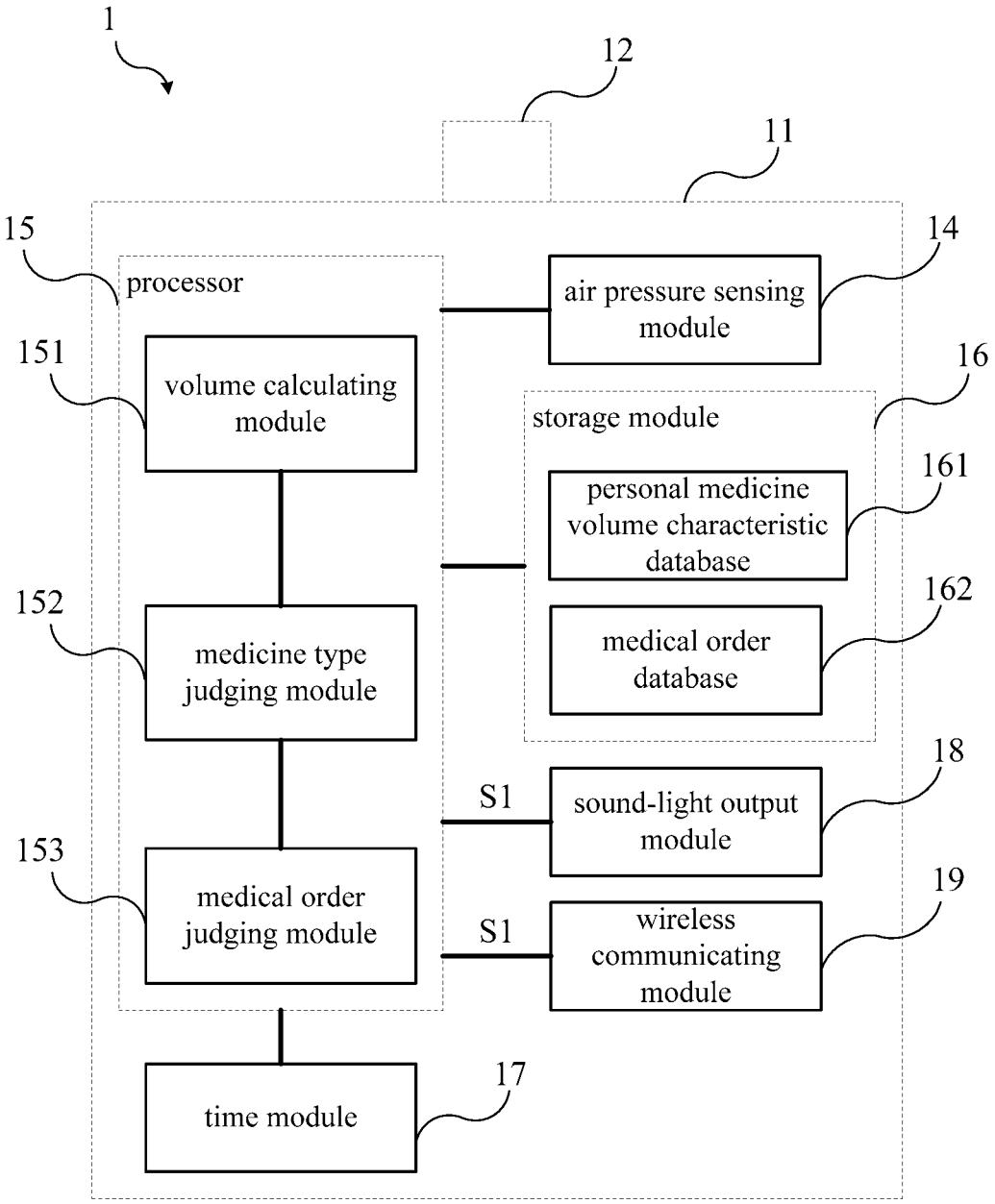

FIG. 4 is a functional block drawing illustrating the intelligent pillbox with volume detection according to an embodiment of the present invention.

Figure 5:
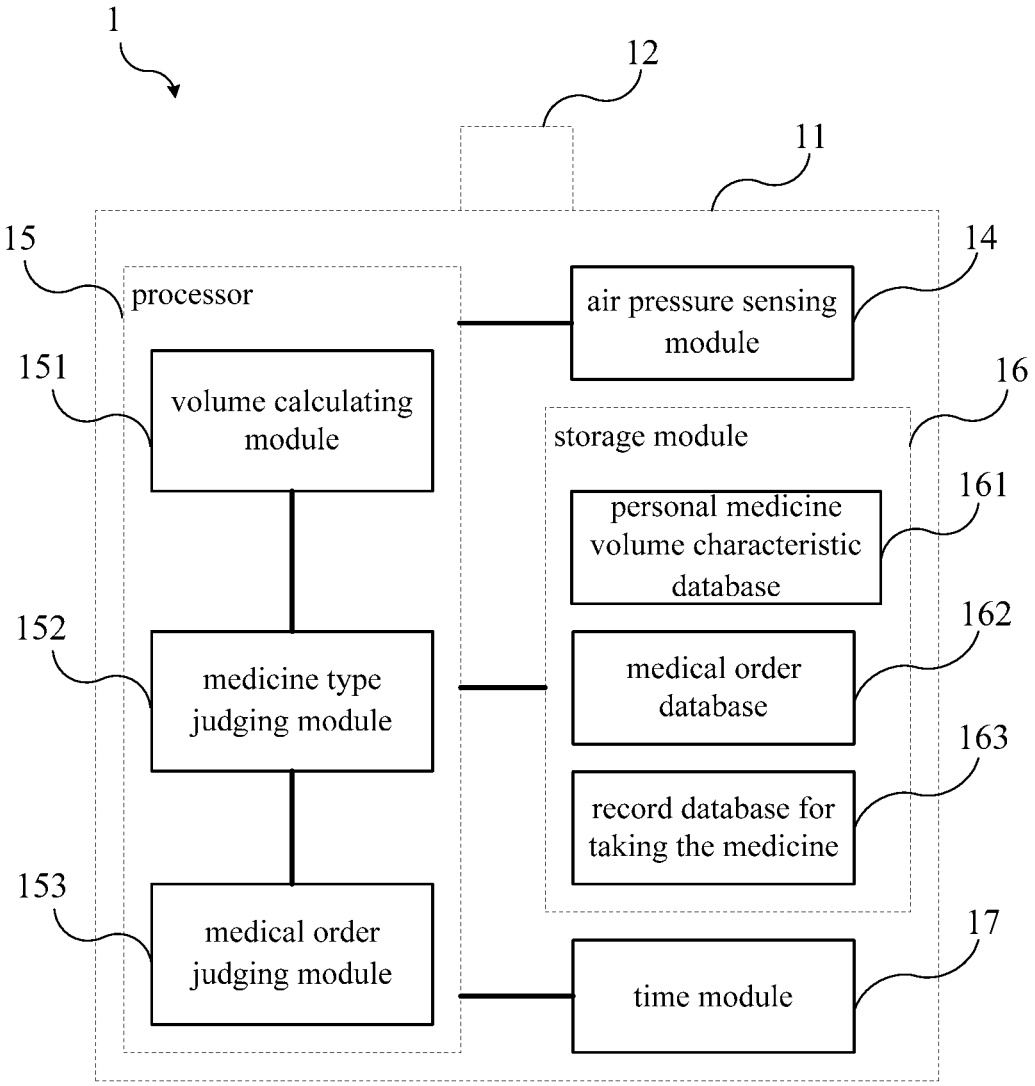

FIG. 5 is a functional block drawing illustrating the intelligent pillbox with volume detection according to an embodiment of the present invention.

Figure 6:
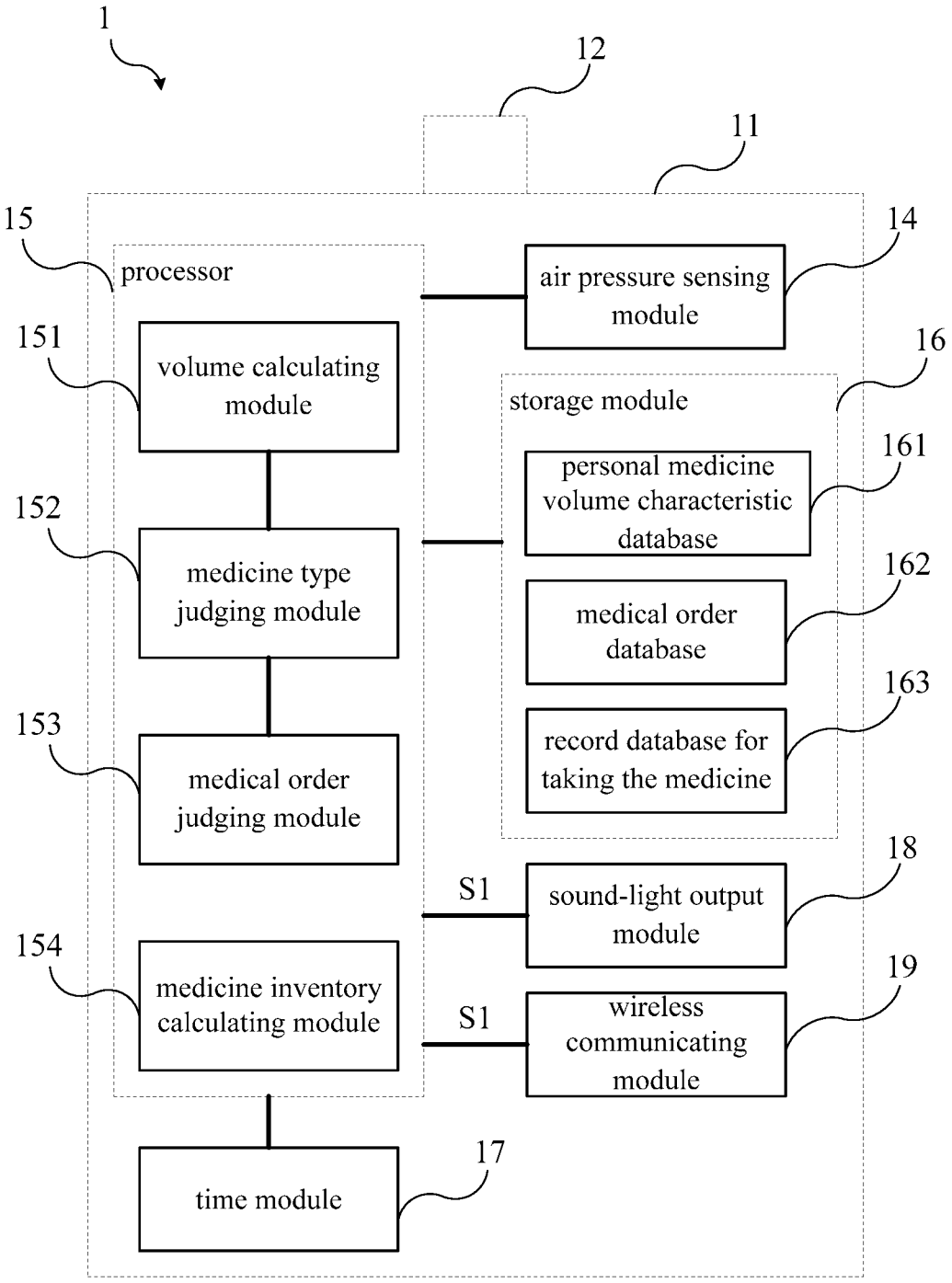

FIG. 6 is a functional block drawing illustrating the intelligent pillbox with volume detection according to an embodiment of the present invention.

Figure 7:
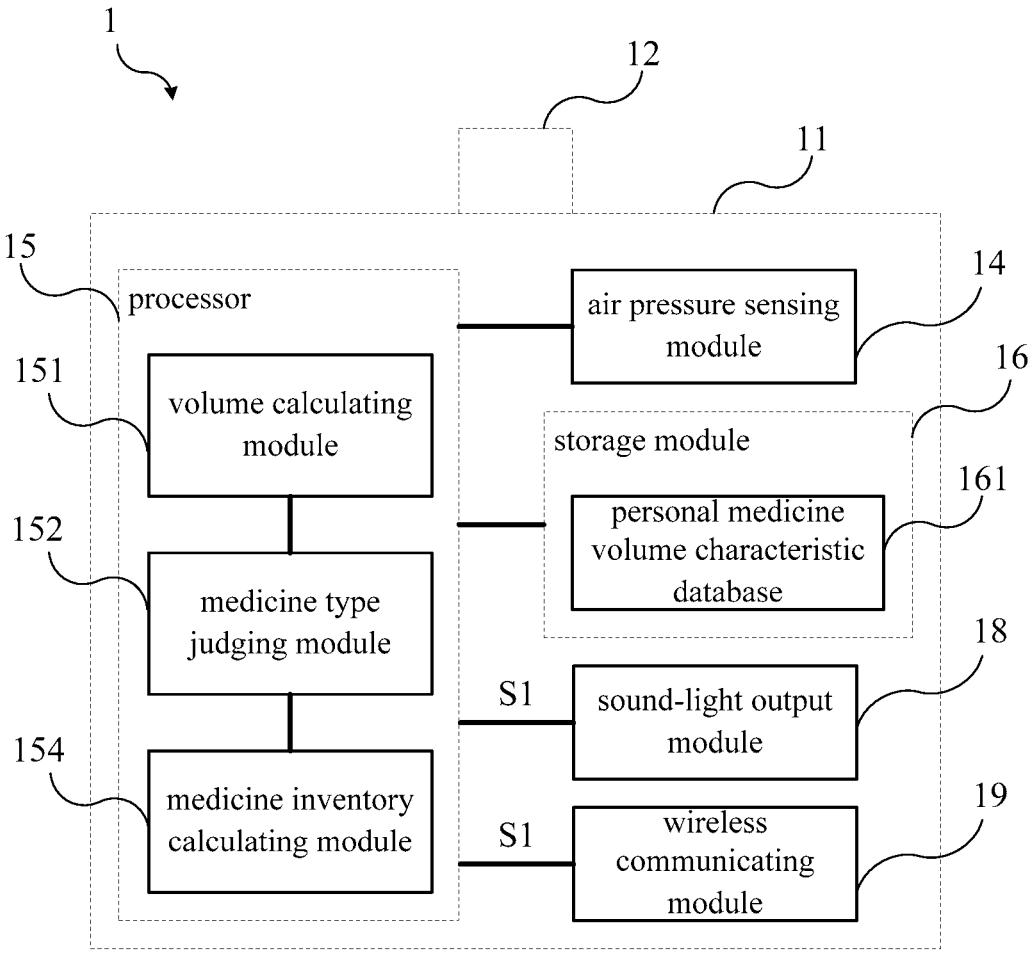

FIG. 7 is a functional block drawing illustrating the intelligent pillbox with volume detection according to an embodiment of the present invention.

DETAILED DESCRIPTION OF THE INVENTION

For the sake of the advantages, spirits and features of the present invention can be understood more easily and clearly, the detailed descriptions and discussions will be made later by way of the embodiments and with reference of the diagrams. It is worth noting that these embodiments are merely representative embodiments of the present invention, wherein the specific methods, devices, conditions, materials and the like are not limited to the embodiments of the present invention or corresponding embodiments. Moreover, the devices in the figures are only used to express their corresponding positions and are not drawing according to their actual proportion.

In the description of the present invention, the description of the terms "one embodiment", "another one embodiment" or "partial embodiment" or the like means that the specific features, structures, materials or characteristics described in connection with the embodiments are included in at least one implementation of the invention. In the present invention, the schematic representation of the above terms does not necessarily refer to the same embodiment. Furthermore, the particular features, structures, materials, or characteristics described may be combined in a suitable manner in any one or more embodiments.

Figure 2:
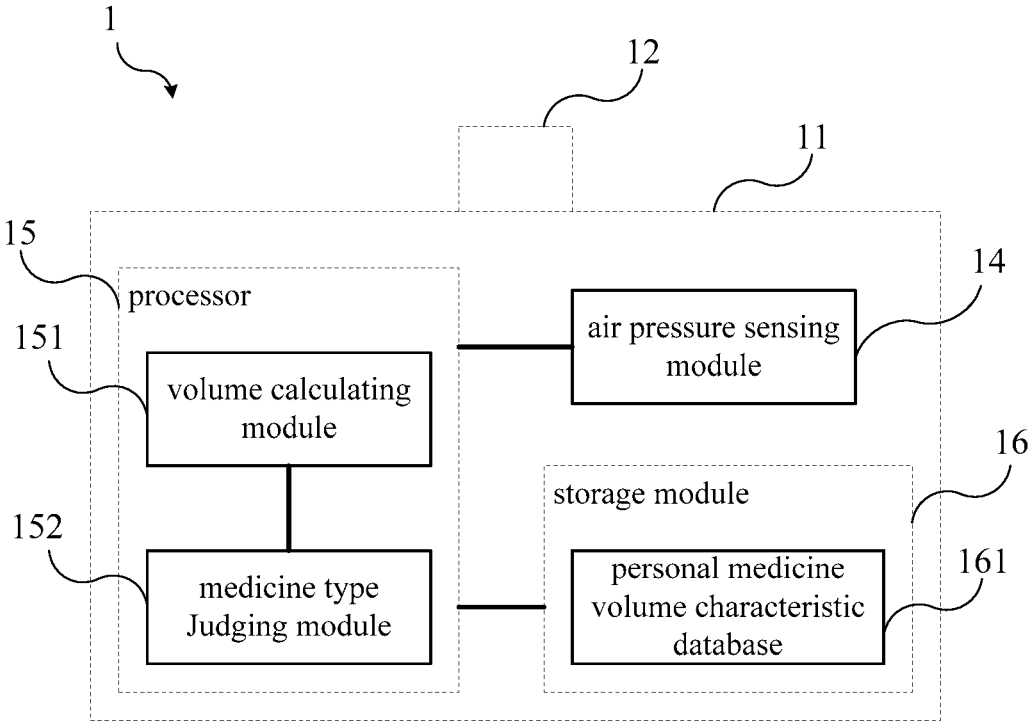
FIG. 2 is a functional block drawing illustrating the intelligent pillbox with volume detection according to an embodiment of the present invention.

Please refer to FIG. 1 and FIG. 2. FIG. 1 is a simple schematic drawing illustrating an appearance of an intelligent pillbox with volume detection 1 of the present invention. FIG. 2 is a functional block drawing illustrating the intelligent pillbox with volume detection 1 according to an embodiment of the present invention. In this embodiment, the intelligent pillbox with volume detection 1 includes an open-close structure 11, a first structure 12, an air pressure sensing module 14 and a processor 15. The open-close structure 11 includes a containing space for containing a medicine, and the containing space is an airtight space when the open-close structure 11 is closed. The first structure 12 is movably configured on the open-close structure 11, and the first structure 12 moves in and out of the airtight space to form a constant volume difference of the airtight space. The air pressure sensing module 14 is configured in the containing space for measuring a plurality of air pressure values in the airtight space. The air pressure values includes a first air pressure value and a second air pressure, wherein the first air pressure value is detected when the first structure 12 moves into the airtight space and the second air pressure value is detected when the first structure 12 moves out of the airtight space. An air pressure difference value is formed between the first air pressure value and the second air pressure value. The processor 15 is connected to the open-close structure 11, and includes a volume calculating module 151 coupled to the air pressure sensing module 14. The volume calculating module 151 calculates an air volume value of the airtight space according to the air pressure difference value and the constant volume difference, and calculates a medicine volume according to a maximum volume value of the containing space and the air volume value. In practical applications, when the patient takes the medicine out of the medicine box and then closes the medicine box, the intelligent pillbox with volume detection 1 can detect the total volume of the remaining medicine in the medicine box. Moreover, a first total volume of the medicine is calculated before opening the medicine box, and a second total volume of the medicine is calculated after closing the medicine box. The volume of taking medicine can be calculated by subtracting the first and the second total volume of the medicine, and then the medicine type and the number of the medicine by the medicine volume can also be judged.

Please refer to FIG. 1, FIG. 3*a* and FIG. 3*b*. FIG. 3*a* is a sectional schematic drawing illustrating the button moving out according to the embodiment of FIG. 1. FIG. 3*b* is a sectional schematic drawing illustrating the button moving in according to the embodiment of FIG. 1. In one embodiment, the first structure 12 is a button set on and through the open-close structure 11. The button includes a pressure applying end 121 and a pressure receiving end 122. The pressure applying end 121 of the button is disposed in the containing space 110, and the pressure receiving end 122 of the button is configured outside of the open-close structure 11. The increased volume of the pressure applying end 121 in the containing space 110 is equal to the constant volume difference when an external force applies on the pressure receiving end 122 to make the button move into the airtight space. That is to say, the volume change of the containing space 110 is equal to the constant volume difference. In practical applications, when the patient closes the medicine box and presses the button into the open-close structure 11, the air volume in the containing space 110 of the medicine box is changed because the volume of the button is increased in the containing space 110, so as to change the air pressure in the medicine box. However, the medicine volume would not be changed by the increased volume of the button in the containing space 110. Therefore, the medicine volume can be calculated by detecting the air pressure change and inversely calculating the air volume in the medicine box. Therefore, the intelligent pillbox with volume detection of the present invention can calculate the remaining medicine volume in the medicine box through volume difference value formed by the button moving into the open-close structure.

In another one embodiment, the decreased volume of the pressure applying end 121 in the containing space 110 is equal to the constant volume difference when the external force applies on the pressure receiving end 122 to make the button move out of the airtight space. This is another way to calculate the medicine volume by detecting the air pressure change and inversely calculating the air volume in the medicine box.

The intelligent pillbox with volume detection 1 calculates the pressure and volume changes of the box according to the Boyle's law to detect the number of remaining medicine. According to the ideal gas equation (PV=nRT) of the Boyle's law, the product of the pressure and volume of the gas is constant for the quantitative gas in the closed vessel and at constant temperature. That is to say, under the condition that the nRT of the ideal gas equation is constant, the pressure is inversely proportional to the volume.

In one embodiment, the air in the containing space 110 of the medicine box includes a first pressure P1 and a first volume V1 to be calculated when the button is not moved into the open-close structure 11. The measureable first pressure P1 is the environment atmosphere pressure (about 1 atm). The air pressure sensing module 14 of the medicine box can measure a second pressure P2 of the air (about greater than 1 atm) after the button is moved into the open-close structure 11. A second volume V2 of the air is the first volume V1 minus the volume value of the button moved into the containing space 110. According to above conditions, the processor 15 of the medicine box can calculate the first volume V1 by the ideal gas equation, and calculate the volume of remaining medicine of the medicine box by the maximum volume of the containing space 110 minus the first volume V1 of the air. Therefore, the medicine box can calculate the number of remaining medicine of the medicine box by detecting the pressure in the containing space 110 of the medicine box and the fixed volume difference value.

In one embodiment, the containing space 110 of the medicine box includes a remaining air volume V3 to be calculated, a measureable third pressure P3 and a measureable pressure change ΔP when the button is moved into the open-close structure 11 with a volume change ΔV. The volume change ΔV is the constant volume difference mentioned above, and the third pressure P3 and the pressure change ΔP are measured by the air pressure sensing module 14 of the medicine box. According to above conditions, the processor 15 of the medicine box can calculate the remaining air volume V3 by the ideal gas equation, and calculate the volume of remaining medicine in the medicine box by the difference between the maximum volume of the containing space 110 and the remaining air volume V3.

In one embodiment, the relative precision of the barometer is 0.06 hPa. If the volume of the medicine box is 100 c.c., the most precise change value of the medicine volume that can be judged of the medicine box is 0.0059 c.c. Generally, the medicine for chronic diseases such as the 25 mg of Carvedilol used in hypertension has a single volume of 0.56 c.c., and the Nateglinide used for lowering blood glucose has a single volume of 0.3 c.c. The single volume of the medicines mentioned above and the volume difference between the different medicines are far greater than 0.0059 c.c. Therefore, the medicine box can precisely detect the remaining medicine volume of the medicine box through the minor pressure in the medicine box and the volume change, and can judge the medicine type according to the medicine volume.

Please continue refer to FIG. 2. In one embodiment, the intelligent pillbox with volume detection 1 further includes a storage module 16. The storage module 16 is coupled to the volume calculating module 151 of the processor 15. The storage module 16 further includes a personal medicine volume characteristic database 161. The personal medicine volume characteristic database 161 stores a plurality of volume data of medicine. The processor 15 further includes a medicine type judging module 152. The medicine type judging module 152 is coupled to the personal medicine volume characteristic database 161 and the volume calculating module 151.

The volume calculating module 151 calculates the plurality of medicine volumes in multiple times and further calculates a volume change value respectively. The medicine type judging module 152 compares whether the volume data of the medicine matches the volume change value, and calculates a number of medicine taken out according to the volume change value and the volume data of the medicine.

In practical applications, the processor 15 can be a CPU, and the storage module 16 can be a memory card, a USB or a device with data storage function. The personal medicine volume characteristic database 161 can include the name, appearance description, volume and so on of the medicine, and can store the medicine data in the storage module 16 according to the medicine type that various patients need to take. Since the different types of medicines have different volumes, the volume and pressure in the medicine box are changed when the patient takes out the medicine and closes the medicine box. At this time, the volume calculating module 151 of the processor 15 can calculate the remaining medicine volume in the medicine box. Then, the volume calculating module 151 calculates the medicine volume taken out according to the remaining medicine volume of the medicine box after opening the medicine box and the remaining medicine volume in the medicine box calculated before opening the medicine box. Finally, the medicine type judging module 152 of the processor 15 compares and judges the type and the number of the medicine taken by the patient according to the medicine volume calculated by the volume calculating module 151 and the medicine data of the personal medicine volume characteristic database 161.

Please refer to FIG. 4. FIG. 4 is a functional block drawing illustrating the intelligent pillbox with volume detection 1 according to an embodiment of the present invention. In one embodiment, the intelligent pillbox with volume detection 1 further includes a time module 17 to record an instant time data. The storage module 16 further includes a medical order database 162. The medical order database 162 includes a volume data and a corresponding time data for taking the medicine. The processor 15 further includes a medical order judging module 153 coupled to the time module 17 and the medical order database 162. The medical order judging module 153 compares whether the volume change value before and after a period of the taking time data is equal to the volume data for taking the medicine according to the instant time data, if not, the medical order judging module 153 outputs a warning signal S1.

In practical applications, the time module 17 can be an electronic clock, and the electronic clock can display the instant time on the medicine box and record it. The medical order database 162 can include the volume data and the time data for taking the medicine, and can store the medicine data in the storage module 16 according to the medicine volume data and the time data for various patients to take medicine. For example, in the medical order data, the patient needs to take 0.5 c.c. of the medicine for lowering blood glucose after lunch, thus the intelligent pillbox can set the time for taking the medicine from 12:30 a.m. to 01:30 p.m. The intelligent pillbox will detect the volume of the medicine box at 01:30 p.m. If the volume change value is 0, the intelligent pillbox will output a warning signal S1 to remind the patient for taking the medicine. In another one embodiment, the medical order database 162 not only can set the time for taking the medicine, but also can set multiple reminding times. When the time for taking the medicine is set from 12:30 a.m. to 01:30 p.m., the intelligent pillbox also can set the reminding times such as every 20 minutes in the time period. The intelligent pillbox will detect the volume of the medicine box at each reminding times. If the volume change value is 0, the intelligent pillbox will output a warning signal S1 to remind the patient for taking the medicine.

In one embodiment, the medical order judging module 153 is further coupled to the medicine type judging module 152. The medical order judging module 153 compares whether the number of medicine taken out matches a medicine data for taking the medicine, and compares whether the instant time data matches to the time data for taking the medicine. If either one does not match, the medical order judging module 153 outputs a warning signal S1. In practical applications, the patient sets the medicine box for taking 0.1 c.c. of the medicine for lowering blood pressure between 10:00 a.m. and 10:30 a.m. and 0.17 c.c. of the medicine for asthma between 09:00 p.m. and 10:00 p.m. according to the medical order. When the patient takes out the wrong medicine, for example, the patient takes out the medicine for asthma at 10:00 a.m., the medicine type judging module 152 of the processor 15 would detect that the volume change value of the medicine box is 0.17 c.c. Because the patient should take 0.1 c.c. of the medicine for lowering blood pressure in this time period, the medical order judging module 153 generates a warning signal S1 and warns the patient for taking the wrong medicine according to the difference of the volume change value detected by the medicine type judging module 152 from the volume data for taking the medicine in the medical order. When the patient takes out the medicine during the non-medication period, for example, the patient takes out the medicine for asthma at 07:00 p.m., the medicine type judging module 152 of the processor 15 detects that the volume change value of the medicine box is 0.17 c.c. and then judges that the medicine is for asthma. Because it is not the time period for taking medicine for asthma, the medical order judging module 153 generates a warning signal S1 and reminds the patient for the correct medication period according to the medicine data detected by the medicine type judging module 152 and the time data for taking the medicine in the medical order.

Please refer to FIG. 5. FIG. 5 is a functional block drawing illustrating the intelligent pillbox with volume detection 1 according to an embodiment of the present invention. In one embodiment, the storage module 16 further includes a record database for taking the medicine 163 coupled to the time module 17 and the medicine type judging module 152. The record database for taking the medicine 163 stores a record data for taking the medicine. The record data for taking the medicine includes the instant time data, the number of medicine taken out corresponding to the instant time data, the volume change value corresponding to the instant time data, and the air volume value corresponding to the instant time data. In practical applications, the record database for taking the medicine 163 stores the taking medicine time recorded by the time module 17, and stores the volume change value, remaining volume value of the medicine box or the number of medicine type stored under the taking medicine time every time the patient takes the medicine. Therefore, the patient's medication history is stored in the record database for taking the medicine 163, so that the patient's medication situation can be tracked in the future.

Please refer to FIG. 6. FIG. 6 is a functional block drawing illustrating the intelligent pillbox with volume detection 1 according to an embodiment of the present invention. In one embodiment, the airtight space formed by closing the open-close structure has a maximum volume value. The processor 15 further includes a medicine inventory calculating module 154 coupled to the record database for taking the medicine 163. The medicine inventory calculating module 154 stores a remaining time threshold value. The processor 15 calculates a remaining time of the air volume value reaching the maximum volume value according to the record data for taking the medicine, the medicine inventory calculating module 154 outputs a warning signal S1 if the remaining time is less than the remaining time threshold value.

In practical applications, because chronic diseases require long-term medication, the doctor will usually make a continuous prescription, and the medicines received each time are usually one month's dose. The patient may forget to replenish the medicine into the medicine box resulting in forgeting to take the medicine if the patient needs to take many types of medicine. If the maximum volume value of the containing space of the medicine box is 40 c.c., the maximum volume value of the air of the containing space is also 40 c.c. If the total volume of the medicine is 20 c.c., that means the remaining air volume of the medicine box is 20 c.c. It is known from the record database for taking the medicine 163 that the total medicine value taken by the patient is 1 c.c., and the medicine will be exhausted after 20 days and the air volume in the containing space of the medicine box will reach a maximum. If the remaining time threshold value is set for 3 days, it means that the air volume of the containing space of the medicine box will reach the maximum volume value after 3 days of reaching the threshold value. Therefore, the medicine inventory calculating module 154 generates a warning signal S1 to remind the patient to replenish the medicine into the medicine box when calculating the air volume in the containing space of medicine box reaching the maximum volume value in 3 days.

Please refer to FIG. 7. FIG. 7 is a functional block drawing illustrating the intelligent pillbox with volume detection 1 according to an embodiment of the present invention. In one embodiment, the medicine inventory calculating module 154 is coupled to the volume calculating module 151 and the personal medicine volume characteristic database 161. The airtight space formed by closing the open-close structure has a maximum volume value. The medicine inventory calculating module 154 calculates a number of remaining medicine types according to the maximum volume value and the air volume value. The medicine inventory calculating module 154 stores a quantity threshold value. The medicine inventory calculating module 154 outputs a warning signal S1 when the number of remaining medicine types is less than the quantity threshold value. In practical applications, if the medicine box includes 10 pieces of medicines for lowering blood glucose, when the patient takes out the medicines, the medicine inventory calculating module 154 calculates the number of remaining medicines according to the volume difference value. If the quantity threshold value is 3, the medicine inventory calculating module 154 outputs a warning signal S1 to remind the patient to replenish the medicine of the medicine box when calculating the number of remaining medicine for lowering blood glucose is less than 3.

Please refer to FIG. 4, FIG. 6 and FIG. 7. In one embodiment, the intelligent pillbox with volume detection 1 of the present further includes a sound-light output module 18 coupled to the processor 15. The sound-light output module 18 outputs a reminder message when receiving the warning signal S1 from the processor 15. In practical applications, the sound-light output module 18 can be one selected from a buzzer, a warning light, a monitor with text display, or the combination thereof. The sound-light output module 18 generates the reminder message to remind the patient with notices such as whether forget taking medicine or not, take the wrong medicine or replenish the medicine of the medicine box when receiving the warning signal S1 generated in above embodiments.

In one embodiment, the intelligent pillbox with volume detection 1 of the present further includes a wireless communicating module 19 coupled to the processor 15. The wireless communicating module 19 is connected to a mobile device storing an application program for outputting the warning signal S1 to the application program of the mobile device. In practical applications, the wireless communicating module 19 can be a Bluetooth module applied on an APP such as a medicine management APP. The mobile device can be a smart phone, and the medicine management APP is also installed in the smart phone. The warning signal S1 is transmitted to the APP of the smart phone through the Bluetooth module when the medicine box outputs the warning signal S1. Therefore, the patient can understand the status of medication any time through the mobile device. In another one embodiment, the wireless communicating module 19 not only can transmit the warning signal S1, but also can transmit the data of the personal medicine volume characteristic database 161, the medical order database 162 and the record database for taking the medicine 163 of the storage module 16. Therefore, the patient can always understand the course of medication and the information of the medicine quantity.

In Summary, the intelligent pillbox with volume detection of the present invention calculates the medicine volume by generating the constant volume difference and detecting the air pressure change of the airtight space. It not only can prevent the patient from taking wrong medicine, but also can detect the number of remaining medicine and remind the patient to replenish the medicine in the medicine box.

The features and spirits of the present invention are hopefully described more clearly by the above detailed description of the preferred embodiments, and the scope of the present invention is not limited by the preferred embodiments disclosed above. On the contrary, the purpose is to cover a variety of changes and equivalence arrangements within the scope of the patent application to be applied for by the creative institute. Although the present invention has been disclosed in the above embodiments, it is not intended to limit the present invention, and anyone skilled in the art can make various changes and refinements without departing from the spirit and scope of the present invention. Therefore, the scope of protection of this present invention is subject to the definition of the scope of the patent application attached.

What is claimed is:

1. An intelligent pillbox with volume detection, comprising:

an open-close structure comprising a containing space for containing a medicine, the containing space forming an airtight space when the open-close structure is closed, and the airtight space comprising an air;

a first structure, movably configured on the open-close structure, the first structure compressing and decompressing the air by moving in and out of the airtight space to generate a constant volume difference of the airtight space;

an air pressure sensing module, configured in the containing space for measuring a plurality of air pressure values in the airtight space, the air pressure values comprising a first air pressure value at compressing the air and a second air pressure value at decompressing the air, an air pressure difference value being formed between the first air pressure value and the second air pressure value; and a processor, coupled to the air pressure sensing module, the processor calculating a medicine volume according to the constant volume difference and the air pressure difference value.

2. The intelligent pillbox of claim 1, wherein the first structure is a button configured on and through the open-close structure, a pressure applying end of the button is disposed in the containing space, a pressure receiving end of the button is disposed outside of the open-close structure, the pressure applying end compresses the air when an external force is applied on the pressure receiving end to make the button move into the containing space.

3. The intelligent pillbox of claim 1, wherein the processor further comprises a volume calculating module coupled to the air pressure sensing module, the volume calculating module calculates an air volume value of the airtight space according to the constant volume difference and the air pressure difference value, and calculates the medicine value according to a maximum volume value of the containing space and the air volume value.

4. The intelligent pillbox of claim 3, further comprising a storage module coupled to the processor and a wireless communicating module coupled to the processor, the storage module storing a medicine information, the wireless communicating module outputting a course of medication and a medicine quantity information to an application program of a mobile device according to the medicine information.

5. The intelligent pillbox of claim 3, further comprising a storage module coupled to the processor, the storage module storing a medicine information, the processor comparing whether the medicine volume value matches to the medicine information, if not, the processor outputting a warning signal.

6. The intelligent pillbox of claim 5, further comprising a sound-light output module coupled to the processor, the sound-light output module outputting a reminder message when receiving the warning signal from the processor.

7. The intelligent pillbox of claim 5, further comprising a wireless communicating module coupled to the processor, the wireless communicating module being connected to a mobile device storing an application program for outputting the warning signal to the application program of the mobile device.

8. The intelligent pillbox of claim 5, further comprising a time module for recording an instant time data, the storage module further comprising a personal medicine volume characteristic database, the personal medicine volume characteristic database storing a plurality of volume data of medicine, the processor further comprising a medicine type judging module coupled to the personal medicine volume characteristic database and the volume calculating module, the processor calculating the plurality of medicine volumes in multiple times and further calculating a volume change value respectively, the medicine type judging module comparing whether the volume data matches the volume change value, and calculating a number of medicine taken out according to the volume change value and the volume data.

9. The intelligent pillbox of claim 8, wherein the storage module further comprises a medical order database, the medical order database stores a medical order data, the medical order data comprises a volume data and a corresponding time data for taking the medicine, the processor further comprises a medical order judging module coupled to the time module and the medical order database, the medical order judging module compares whether the volume change value before and after a period of the taking time data is equal to the volume data for taking the medicine according to the instant time data, if not, the medical order judging module outputs the warning signal.

10. The intelligent pillbox of claim 8, wherein the medical order judging module is further coupled to the medicine type judging module, the medical order judging module compares whether the number of medicine taken out of the containing space matches a medicine data for taking the medicine, and compares whether the instant time data matches to the time data for taking the medicine, if either one does not match, the medical order judging module outputs the warning signal.

11. The intelligent pillbox of claim 8, wherein the storage module further comprises a record database for taking the medicine coupled to the time module and the medicine type judging module, the record database for taking the medicine stores a record data for taking the medicine, the record data for taking the medicine comprises the instant time data, the number of medicine taken out corresponding to the instant time data, the volume change value corresponding to the instant time data, and the air volume value corresponding to the instant time data.

12. The intelligent pillbox of claim 11, wherein the processor further comprises a medicine inventory calculating module coupled to the record database for taking the medicine, the medicine inventory calculating module stores a remaining time threshold value, the processor calculates a remaining time of the air volume value reaching the maximum volume value according to the record data for taking the medicine, the medicine inventory calculating module outputs the warning signal if the remaining time is less than the remaining time threshold value.

13. The intelligent pillbox of claim 8, wherein the processor further comprises a the medicine inventory calculating module coupled to the volume calculating module and the personal medicine volume characteristic database, the medicine inventory calculating module calculates a number of remaining medicine types according to the maximum volume value and the air volume value, the medicine inventory calculating module stores a quantity threshold value, the medicine inventory calculating module outputs the warning signal when the number of remaining medicine type is less than the quantity threshold value.

14. An intelligent pillbox with volume detection, comprising:

an open-close structure comprising a containing space for containing a medicine, the containing space forming an airtight space when the open-close structure is closed, and the airtight space comprising an air; and a button, movably set on and through the open-close structure, a pressure applying end of the button being disposed in the containing space, a pressure receiving end of the button being configured outside of the open-close structure, the pressure applying end compressing the air to generate a constant volume difference when an external force is applied on the pressure receiving end to make the button move into the containing space.

15. The intelligent pillbox of claim 14, further comprising an air pressure sensing module configured in the containing space for measuring a plurality of air pressure values in the airtight space, the air pressure values comprising a first air pressure value at compressing the air and a second air pressure value at decompressing the air, an air pressure difference value forming between the first air pressure value and the second air pressure value, wherein the air pressure difference value and the constant volume difference are used for calculating a medicine volume.

* * * * *